US010481560B2

(12) United States Patent
Bisig et al.

(10) Patent No.: US 10,481,560 B2
(45) Date of Patent: Nov. 19, 2019

(54) METHOD OF MEASURING A TIME IN A SPORTS COMPETITION USING A TRANSPONDER MODULE, AND TRANSPONDER MODULE FOR IMPLEMENTING THE METHOD

(71) Applicant: SWISS TIMING LTD, Corgemont (CH)

(72) Inventors: Martin Bisig, Zuchwil (CH); Andre Zanetta, Wavre (CH)

(73) Assignee: SWISS TIMING LTD, Corgemont (CH)

( * ) Notice: Subject to any disclaimer, the term of this patent is extended or adjusted under 35 U.S.C. 154(b) by 1029 days.

(21) Appl. No.: 14/100,881

(22) Filed: Dec. 9, 2013

(65) Prior Publication Data

US 2014/0169140 A1 Jun. 19, 2014

(30) Foreign Application Priority Data

Dec. 19, 2012 (EP) ..... 12198207

(51) Int. Cl.
*G04F 8/08* (2006.01)
*G07C 1/22* (2006.01)

(52) U.S. Cl.
CPC ..... *G04F 8/08* (2013.01); *G07C 1/22* (2013.01)

(58) Field of Classification Search
CPC ..... G04F 8/08; G07C 1/22
USPC ..... 700/91; 368/2
See application file for complete search history.

(56) References Cited

U.S. PATENT DOCUMENTS 5,511,045 A 4/1996 Sasaki et al.
5,685,722 A 11/1997 Taba
6,266,623 B1 7/2001 Vock et al.
6,346,055 B1 * 2/2002 Rege ..... A63B 57/357 368/10

(Continued)

FOREIGN PATENT DOCUMENTS

WO 2010/119084 A1 10/2010
WO 2011/012666 A1 2/2011

OTHER PUBLICATIONS

European Search Report of EP12198207 dated May 23, 2013.
Communication dated Mar. 14, 2017, by the European Patent Office in copending European Application No. 12 198 207.8.

*Primary Examiner* — Omkar A Deodhar
*Assistant Examiner* — Wei Lee
(74) *Attorney, Agent, or Firm* — Sughrue Mion, PLLC

(57) ABSTRACT

The invention concerns a method of measuring at least one time or an elapsed period of a competitor in a sports competition via a transponder module which is personal to the competitor and accompanies the competitor throughout the competition in a measuring system. The personalized transponder module is activated at the start of the competition or in intermediate positions or at the finish line of the competition (6). Detection of at least one variation in motion or vibration level is effected by a motion sensor (11) integrated in the transponder module. The transponder module transmits data related to the detection effected by the motion sensor on the competition route or in intermediate positions or at the finish line of the competition, to a decoder unit (4) of the measuring system to check a time or elapsed period related to the detection of the competitor's motion sensor.

7 Claims, 2 Drawing Sheets

(56) References Cited

U.S. PATENT DOCUMENTS

| | | | | |
|---|---|---|---|---|
| 8,279,051 | B2 * | 10/2012 | Khan | A63B 24/0021 340/323 R |
| 2005/0020369 | A1 * | 1/2005 | Davis | A63B 69/3614 473/131 |
| 2005/0285739 | A1 * | 12/2005 | Velhal | G08B 21/0227 340/572.1 |
| 2006/0259275 | A1 | 11/2006 | Maschke | |
| 2007/0202801 | A1 | 8/2007 | Frantz | |
| 2007/0298853 | A1 * | 12/2007 | Yu | A63K 3/02 463/6 |
| 2013/0274904 | A1 * | 10/2013 | Coza | G06F 3/011 700/91 |
| 2014/0052279 | A1 * | 2/2014 | Van Rens | A63B 24/0021 700/91 |

* cited by examiner

METHOD OF MEASURING A TIME IN A SPORTS COMPETITION USING A TRANSPONDER MODULE, AND TRANSPONDER MODULE FOR IMPLEMENTING THE METHOD

This application claims priority from European Patent Application No. 12198207.8 filed 19.12.2012, the entire disclosure of which is incorporated herein by reference.

FIELD OF THE INVENTION

The invention concerns a method of measuring at least one time or an elapsed period of a competitor in a sports competition by means of a transponder module which is personal to the competitor and accompanies the competitor throughout the competition in a measuring system.

The invention also concerns a transponder module for implementing the method of measuring at least one time or an elapsed period in a sports competition.

BACKGROUND OF THE INVENTION

In a sports competition, it is often necessary to use several devices to detect and store the measured time of a race, in order to ensure the serviceability of the measuring system. These devices must also ensure good measurement accuracy and measurement security to be able to form an automated measuring system. The devices used in this type of measuring system are, for example, contact strips, cameras, photoelectric cells and transponders.

It should also be noted that if the time difference between athletes is less than the accuracy of the transponders used, a manual checking operation must also be used. The conventional measuring system cannot therefore be entirely automated, which is a drawback.

An electrical contact, arranged on the finish line, has often been used to measure time in track cycling races. This electrical contact is closed by the bicycle crossing the finish line, which enables the intermediate time or finish time of each cyclist to be determined. A manual checking operation must also be provided, since no information relating to each cyclist is transmitted each time the finish line is crossed. Moreover, this type of electrical contact may produce electrostatic discharges which are liable to be strongly felt by each cyclist as he crosses the finish line. This is therefore a drawback of this type of non-automated measuring system.

SUMMARY OF THE INVENTION

It is therefore an object of the invention to overcome the drawbacks of the aforementioned prior art by proposing a method of measuring at least one time or an elapsed period of a competitor in a sports competition via a personalised transponder module which accompanies the competitor in an automated measuring system, in order to deliver accurate time or measured elapsed period data.

The invention therefore concerns a method a method of measuring at least one time or an elapsed period of a competitor in a sports competition via a transponder module personal to the competitor and accompanying the competitor during the competition in a measuring system, the method including the steps consisting in:

activating the personalised transponder module at the start of the competition or in one or more intermediate positions of the competition or at the finish line of the competition, detecting at least one variation in motion or a level of vibrations via a motion sensor, which is integrated in the transponder module, and transmitting, via the transponder module, the data linked to one or more detections effected by the motion sensor on the competition route or in intermediate positions or at the finish line of the competition, to a decoder unit of the measuring system in order to check at least one time or an elapsed period linked to one or more detections by the motion sensor of the competitor.

Particular steps of the method of measuring at least one time or an elapsed period are defined in the dependent claims 2 to 11.

One advantage of the method of measuring a time or an elapsed period of a competitor in a sports competition lies in the fact that the use of one or more transponder modules personal to each competitor for saving the measured time involves only a slight additional complexity in the measuring system. The time that a competitor crosses an intermediate position or the finish line of a competition can be very accurately detected in an automated manner by the measuring system. Each transponder module can communicate on a determined communication channel with very slight additional complexity.

Advantageously, the transponder module can be activated by at least one low frequency signal transmitted by the antenna of a transmission unit of the measuring system. The module can be activated from the start of the sports competition or at intermediate positions, which each include a low frequency signal transmission unit, or also at the finish of said sports competition. The motion sensor, which may be an accelerometer, may also be activated in the transponder module upon reception of the low frequency signal. The transponder module can transmit any data connected to detection by the motion sensor via a high frequency data signal to a decoder unit of the automated measuring system. According to the variations in motion or vibrations detected by the motion sensor, the automated measuring system can determine at least one race time or elapsed period on the competition route.

Advantageously, the transponder module with the measuring system motion sensor can be used for any type of sports competition. This may be a track cycling race where a variation in motion or an impact is detected by the motion sensor on the front fork of the bicycle on crossing a strip of determined thickness on the finish line.

It may be a long distance swimming competition where the motion sensor detects the impact of the swimmer's hand, which is carrying the transponder module, against the wall at the finish of the competition.

It may be a ski race where the motion sensor detects each turn made by the skier as he passes each slalom or downhill pole. In that case, the transponder module is activated at the start of the race, synchronised with an integrated time base and each time at which the poles are passed is stored. All the stored data is transmitted to a decoder station when the finish line is crossed.

It may also be a mountain bike or BMX race or even an athletics race. In that case, the motion sensor is used to determine the bicycle 'off ground time', i.e. all the times when the bike is not in contact with the ground or track during the race. In the case of athletics, the number of the runner's strides can be determined, for example by taking account of the measured time between each variation in the measuring signal level detected by the motion sensor.

The invention therefore also concerns a transponder module for implementing the method of measuring a time or an elapsed period in a sports competition, wherein the transponder module includes a motion sensor able to deliver at least one measurement signal of at least one detection of a variation in motion of said module or a level of vibrations of said module, in order to transmit the data from one or more detections of the motion sensor to a decoder unit of a measuring system to determine a time or an elapsed period of a competitor in a sports competition.

Particular embodiments of the transponder module are defined in the dependent claims 13 to 20.

Advantageously, the transponder module includes a motion sensor, which is connected to a microcontroller of the transponder module. The transponder module may be of the active type, but woken up upon reception of a low frequency signal from at least one transmission unit of the measuring system.

Advantageously, the motion sensor may be a triaxial accelerometer or a unit including a triaxial accelerometer, a triaxial gyrometer and a triaxial magnetic sensor. Each detection of a motion variation or vibrations is communicated to the microcontroller, to be processed by the microcontroller and stored.

BRIEF DESCRIPTION OF THE DRAWINGS

The objects, advantages and features of the method of measuring at least one time or an elapsed period in a sports competition via a transponder module in an automated measuring system, and the transponder module for implementing the same will appear more clearly in the following description of at least one non-limiting embodiment illustrated by the drawings, in which.

DETAILED DESCRIPTION OF THE INVENTION

In the following description, all those elements of the transponder module for implementing the time or elapsed period measuring method, or of the measuring system, which are well known to those skilled in the art in this technical field, will only be described in a simplified manner.

Figure 1:
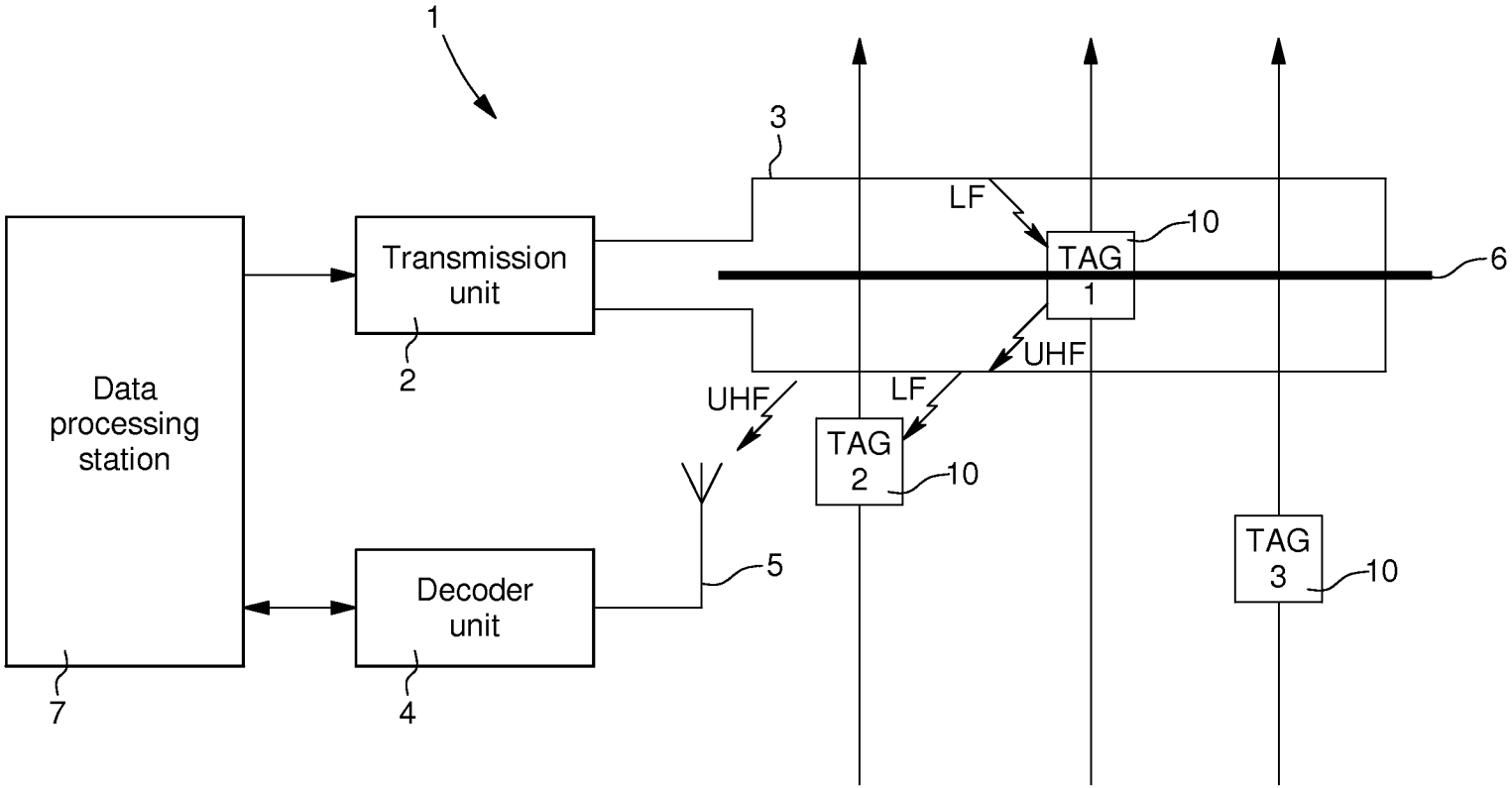
FIG. 1 is a schematic view of an automated measuring system, which includes several transponder modules for implementing the method of measuring at least one sports competition time according to the invention.

FIG. 1 is a schematic view of an automated measuring system 1, which may be used in any type of sports competition. However, FIG. 1 shows this type of automated measuring system, which may for example be used to measure a passing time or finish time in a track cycling race.

The time measuring system 1 is mainly formed of one or more transponder modules 10, defined as TAG1, TAG2 and TAG3. Each transponder module 10 is personal to each competitor, and also includes, as explained below, a motion sensor for detecting any motion variation or vibrations. Normally, the motion sensor detection is delivered for any motion variation or for a level of vibrations beyond a defined detection threshold.

For a track cycling race, transponder module 10 may be mounted on the front fork of the bicycle.

The personalised transponder module 10 is preferably an active transponder module, i.e. provided with a battery for the electrical powering of its constituent components. However, to reduce the electric power consumption, it is generally in rest mode. In the embodiment shown in FIG. 1, each transponder module 10 can be activated mainly when it is able to detect a low frequency signal LF transmitted by a transmission antenna 3 of a transmission unit 2 of measuring system 1. The low frequency signal transmitted by said transmission unit 2 may be, for example, at a frequency of around 125 kHz. This transmission unit may be conventionally controlled by a data processing station 7 of measuring system 1. It can transmit the low frequency signal LF via transmission antenna 3 throughout the entire competition.

Transmission antenna 3 may be arranged in or on the ground of the track. It is preferably centred on the finish line 6 and may extend over the entire width of the track. The width of transmission antenna 3 may be between 10 cm and 2 m, the normal width being around 60 cm. Generally, each transponder module can be activated by the low frequency signal transmitted by the transmission antenna at a distance of around 2 m from the finish line. The closer transponder module 10 comes to finish line 6, the more the level of low frequency signal LF picked up by the transponder module increases. The level of low frequency signal LF picked up by the transponder module varies as a function of position and distance with respect to the centre of the antenna. A signal analysis algorithm enables the position of the transponder module to be determined with respect to finish line 6.

As shown in FIG. 1, the first transponder module TAG1 is located on finish line 6. It is activated by low frequency signal LF from transmission antenna 3. The second transponder module TAG2 is located close to transmission antenna 3. It can also be already activated by low frequency signal LF from transmission antenna 3, but said received low frequency signal LF is at a low level. The third transponder module TAG3 is far from transmission antenna 3. In these conditions, the third transponder module is not activated by low frequency signal LF from the transmission antenna and remains in rest mode.

Given that the transponder module is arranged on the front fork of the bicycle, the height of the module varies very little with respect to the track. This enables the time that a competitor passes or finishes to be measured in decoder unit 4 by calculating the maximum field value received by the transponder module. To achieve this, the transponder module measures various levels of the received low frequency signal via a received signal strength indicator circuit. It transmits the various measured field levels in a data signal to decoder unit 4, which therefore determines the time that the cyclist passes or finishes on his bicycle. However, measuring the time that the competitor passes or finishes simply by determining the maximum field value detected by the transponder module is not sufficiently accurate.

For this type of track cycle competition, the finish line is formed of a strip 6 of a determined thickness capable of generating an impact when crossed by a cycle wheel. This thickness of said strip may be around 1 to 3 mm. Each time the line is crossed, this causes a measuring signal to be delivered in the form of an impulse from the motion sensor. This impulse generated by said motion sensor can be used to trigger the time upon each crossing of the line, and also to accurately determine the finish time of the competitor in decoder unit 4.

The measuring signal in the form of an impulse delivered by the motion sensor can be controlled and transmitted by transponder module 10. A data signal is transmitted by the transponder module to be picked up by a receiver antenna 5 of a decoder unit 4 of measuring system 1. This data signal may have a frequency, for example, of between 800 MHz and 900 MHz. The data transmitted by the transponder module is accurate, because it is triggered at the moment the cycle crosses said finish line by the detection of a motion variation by the motion sensor.

In the case of a motion sensor in the form of an accelerometer with three measurement axes, the data signal transmitted by transponder module 10 contains the measurement on the three measurement axes. The measurement is generally taken every 3 ms and the data signal, which contains all these measurements, is transmitted by active transponder module 10 to decoder unit 4 every 12 ms. However, other temporal values may be envisaged depending on the electronic components used in the transponder module.

The decoder unit 4 may also be connected to the data processing unit 7 of measuring system 1. This station 7 may be used for processing data from decoder unit 4 and displaying the various times of the competitors with their ranking. Decoder unit 4 may also be used to program each transponder module 10 to personalise said module for the respective competitor. Moreover, in the event that the transponder module has to be activated at the start of the competition, decoder unit 4 can synchronise a time base of the transponder module at the moment that the competitor starts. In these conditions, it is no longer necessary to use a transmission unit 2 for a low frequency signal LF, since the time measurement can be performed directly inside the transponder module. The transponder module transmits the competitor's finish time data signal to decoder unit 4 at the moment when the motion sensor detects the front wheel of the bicycle crossing the finish line.

Transponder module 10 may also perform a time measurement or supply position data on the basis of the received field level measurement. This well known received field measurement is carried out in the transponder module by an RSSI circuit, which is a received signal strength indicator circuit. The closer the transponder comes to the centre of the transmission antenna, the stronger the received field will be. In theory, this transmission antenna is centred in the ground at the finish line. The transponder module is powered on when it comes close to this antenna, and may, from that moment, perform several received field strength measurements. If the height of the transponder module is constant during the competitor's movement, the curve of the defined received field level has a Gaussian form with the maximum level at the centre of said transmission antenna.

Figure 2:
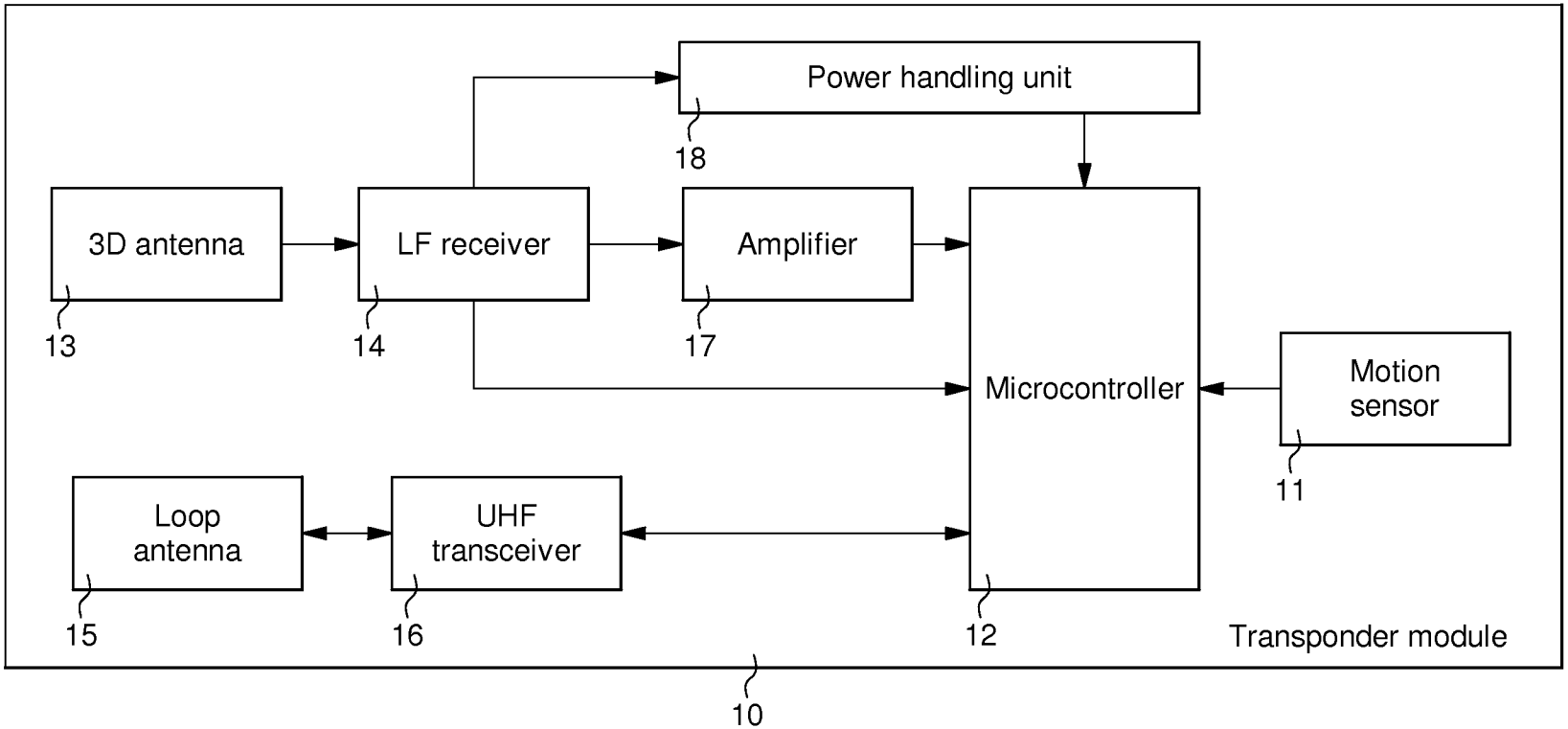
FIG. 2 shows an embodiment of a transponder module for implementing the method of measuring at least one time in accordance with the invention.

One embodiment of transponder module 10, which can be used for any type of sports competition, particularly a track cycle race, is shown in FIG. 2. The transponder module mainly includes a motion sensor 11 capable of delivering at least one measurement signal for at least one detected motion variation in said module or detected vibration level of said module. A data signal relating to one or more detections by the motion sensor may be transmitted to a decoder unit 4 of a measuring system 1 for determining a time or an elapsed period of a competitor during a sports competition.

The motion sensor 11 of the transponder module may be an accelerometer with three measurement axes, or a unit which includes a triaxial accelerometer, a triaxial gyrometer and a triaxial magnetic sensor. Motion sensor 11 is connected to a microcontroller 12 of the transponder module for controlling the measurement signals or storing the various motion sensor measurement signals.

The transponder module may include a low frequency signal receiver 14 for receiving low frequency signals via a triaxial antenna 13. The transponder module may be of the active type with a battery for the electrical powering of the electronic components of the transponder module. To reduce the electric power consumption of the transponder module, a power handling unit 18 may be provided. The battery may form part of this handling unit or be connected thereto. The power handling unit can manage the electric power supply to the electronic components of the module. Normally, the power handling unit 18 can operate the electric power supply as soon as a low frequency signal is received by the transponder module.

The transponder module also includes a high frequency transceiver 16 for the transmission by a loop antenna 15 of one or more data signals at a carrier frequency of between 800 MHz and 900 MHz. The data signal or signals are transmitted at the command of microcontroller 12 to a decoder unit 4 of a measuring system 1. Preferably, the transponder module may also include a time base in conjunction with microcontroller 12, where the transponder module has to be activated at the start of the competition. This time base is capable of being synchronised at the start time of the sports competition by reception, in loop antenna 15, of a synchronisation or control signal from the decoder unit.

The low frequency signal receiver 14 of the transponder module is connected to the microcontroller and to the power handling unit 18. The receiver output is also connected to an amplifier 17, which delivers an amplified reception signal to microcontroller 12 for measuring the field level detected by the transponder module. This also increases the measurement dynamics. Thus, it is possible to pick up tiny low frequency signals or very strong low frequency signals.

It should also be noted that motion sensor 11, connected to microcontroller 12, may be used to determine a speed or an acceleration. A speed or acceleration measurement of a competitor may be useful in athletics, particularly for a sprint.

The time or elapsed period measuring method of the present invention may be applied to a ski competition, for example a ski race, such as a Super G, Giant slalom or Special slalom. In this case, with the transponder module, the turns made by the skier could be detected each time he crossed a pole. To achieve this, the transponder module could be activated at the moment that the competitor starts and synchronised with the time base integrated in the transponder. Thus, the transponder module can store the instant of each turn performed by the skier via the detection provided by the motion sensor, such as an accelerometer. Once the finish line has been crossed, all the data stored during the race time by the transponder module can be transmitted to a decoder unit of the measuring system to process all the personalised data of each competitor.

The time or elapsed period measuring method of the present invention may also be applied to a sports competition such as mountain biking, BMX, skiing, snowboarding, or athletics. The method can determine, for example, a bicycle 'off ground time', i.e. all the periods of time during which the bicycle is not in contact with the ground or the track during the race. For an athletics race, the number of the runner's strides can be determined, for example by taking account of the measured time between each variation in the measuring signal level detected by the motion sensor.

The time or elapsed period measuring method of the present invention may also be applied to a sports competition such as long distance swimming. In such case, the measuring system resembles that described with reference to FIG. 1. Each swimmer carries a bracelet provided with the transponder module on at least one wrist. At the moment the swimmer's hand touches a finishing contact plate carrying a transmission antenna of the measuring system transmission unit, the impulse generated by the motion sensor is directly transmitted by the transponder module to a decoder unit. This impulse delivers accurate data personal to the swimmer to the decoder unit to establish, in an automated manner, the time of each swimmer and immediately defines the swimmers' ranking. The active transponder module may be activated, when it is at a distance of around 30 cm from the contact plate at the finish of the swimming race.

From the description that has just been given, several variants of the method of measuring at least one time or an elapsed period in a sports competition can be devised by those skilled in the art without departing from the scope of the invention defined by the claims. The transponder module can be manually activated throughout the entire duration of the sports competition. The activation and synchronisation of the transponder module time base may be achieved by the low frequency signal transmission unit.

What is claimed is:

1. A method of measuring time of a competitor in a sports competition via a transponder module personal to the competitor and accompanying the competitor during the competition in a measuring system, the method comprising:

receiving a low frequency signal transmitted from a transmission antenna of the measuring system;

transmitting at least one signal strength of the received low frequency signal to the measuring system;

detecting variation in motion of the transponder module via a motion sensor integrated in the transponder module;

transmitting, via the transponder module, data indicating the variation in motion detected by the motion sensor to the measuring system;

determining, by the measuring system, that the data indicating the variation in motion detected by the motion sensor corresponds to motion of the competitor caused by disposition of the competitor at a predetermined position in the sports competition; and determining, by the measuring system, a time of the competitor in the sports competition based on the at least one signal strength of the low frequency signal and a time of the motion of the competitor detected by the motion sensor caused by disposition of the competitor at the predetermined position in the sports competition, wherein the predetermined position in the sports competition comprises an intermediate position or a finish line of the competition route.

2. The measuring method according to claim 1, further comprising:

activating the transponder module based on the low frequency signal.

3. The measuring method according to claim 2, wherein the activating comprises activating the transponder module based on the low frequency signal transmitted by the at least one antenna arranged in or on the ground of the competition route in an intermediate position or at a finish line of the competition route.

4. The measuring method according to claim 2, wherein the measuring system is arranged to measure at least one time of a track cycling race, the transponder module personal to a cyclist being arranged on a front fork of a bicycle and the antenna of the transmission unit being arranged centred on a finish line, which includes a strip of determined thickness for generating variation in the motion sensor when the front wheel of the bicycle crosses the strip, wherein the detecting comprises detecting the variation in motion by the motion sensor when the finish line is crossed, and wherein the transmitting comprises transmitting the data and the at least one signal strength to the measuring system to determine an intermediate time or a finish time for the cyclist.

5. The measuring method according to claim 4, further comprising:

measuring the at least one signal strength of the received low frequency signal via a received signal strength indicator circuit in the transponder module, wherein the transmitting the data comprises transmitting the at least one signal strength to the measuring system to determine an intermediate time or a finish time of the cyclist on the basis of a maximum signal strength of the at least one signal strength.

6. The measuring method according to claims 1, wherein transponder module transmits at a carrier frequency of between 800 MHz and 900 MHz.

7. The measuring method according to claim 1, further comprising activating a time base of the transponder module at a start of the sports competition, wherein the time base is synchronised at the start of the sports competition.

* * * * *